US012624518B2

(12) United States Patent
McGuckin

(10) Patent No.: US 12,624,518 B2
(45) Date of Patent: May 12, 2026

(54) TOOL FOR AN EXCAVATOR

(71) Applicant: Strickland Ireland Limited, Dungannon (GB)

(72) Inventor: Connor McGuckin, Dungannon (GB)

(73) Assignee: STRICKLAND IRELAND LIMITED, Dungannon (GB)

( * ) Notice: Subject to any disclaimer, the term of this patent is extended or adjusted under 35 U.S.C. 154(b) by 854 days.

(21) Appl. No.: 17/519,154

(22) Filed: Nov. 4, 2021

(65) Prior Publication Data

US 2022/0136202 A1 May 5, 2022

(30) Foreign Application Priority Data

Nov. 4, 2020 (GB) ..... 2017460

(51) Int. Cl.
*E02F 3/413* (2006.01)
*E02F 3/40* (2006.01)

(52) U.S. Cl.
CPC ..... *E02F 3/4135* (2013.01); *E02F 3/404* (2013.01)

(58) Field of Classification Search
CPC ..... E02F 3/404; E02F 3/4135; E02F 3/3622; E02F 3/413; E02F 3/964; E02F 3/2271
See application file for complete search history.

(56) References Cited

U.S. PATENT DOCUMENTS 4,804,309 A * 2/1989 Risch ..... E02F 3/962 414/723
5,111,602 A * 5/1992 Risch ..... E02F 3/404 414/722
5,813,822 A * 9/1998 Pisco ..... E02F 3/3622 414/723
7,165,930 B2 * 1/2007 Pisco ..... E02F 3/404 37/406
7,617,619 B2 * 11/2009 Cox ..... E02F 3/404 37/406
9,404,236 B2 * 8/2016 Toraason ..... E02F 3/404
9,777,458 B2 * 10/2017 Bargellini ..... E02F 3/40
10,774,501 B2 * 9/2020 Frey ..... E02F 9/22
(Continued)

FOREIGN PATENT DOCUMENTS

KR 20020090994 A 12/2002
WO 2012010921 A1 1/2012

OTHER PUBLICATIONS

1st examination report from UKIPO dated May 3, 2024 for related foreign application No. GB2115900.9 (1 pp).
(Continued)

*Primary Examiner* — Christopher J Sebesta
*Assistant Examiner* — Blake E Scoville
(74) *Attorney, Agent, or Firm* — Renner, Kenner; Arthur M. Reginelli

(57) ABSTRACT

A tool for an excavator has a primary engagement arrangement, a secondary engagement arrangement rotatable about an axis of rotation, and a connection arrangement for connecting the tool to an excavator. The axis of rotation of the secondary engagement arrangement passes through the connection arrangement and aligns with the axis of rotation of the tool relative to the excavator. The tool has two hydraulic actuators. The secondary engagement arrangement and the primary engagement arrangement mutually rotate about the same axis of rotation by the hydraulic actuators.

19 Claims, 10 Drawing Sheets

(56) References Cited

U.S. PATENT DOCUMENTS

| | | | | |
|---|---|---|---|---|
| 2005/0220601 | A1* | 10/2005 | Pisco | E02F 3/404<br>414/723 |
| 2008/0016729 | A1* | 1/2008 | Holp | E02F 3/407<br>37/443 |
| 2009/0077840 | A1 | 3/2009 | Zeno et al. | |

OTHER PUBLICATIONS

AG Manufacturing, Inc., Product guide, 2019, TAG Manufacturing, Inc. Available at: https://tagmfg.us/wp-content/uploads/2019/03/TAG-Brochure-2019.pdf.

AMI Attachments, Feb. 8, 2012, AMI Attachments Excavator Pro-Link Thumb 02, YouTube GB, [online], available from: https://www.youtube.com/watch?v=blelLcW4jx8.

* cited by examiner

TOOL FOR AN EXCAVATOR

The present invention relates to an accessory for an engineering vehicle and more specifically to a tool for an excavator.

Excavators are often used during building works to move or remove onsite material. Excavators typically include at least one hydraulically-powered boom extending from a main body, a bucket being attached to the end of the boom via one or more mounting pins or a coupler. One of the key parameters which determines whether a given bucket is suitable for a particular task is breakout force. Breakout force is the amount of force that the leading edge of the bucket can exert on material and is largely determined by the distance between the pivot point of the bucket and its leading edge. Generally speaking, a higher breakout force will result in improved excavator performance in a harder digging situation.

While excavator buckets are useful for moving soil and other aggregates, they are not ideally suited to picking up and handling larger objects such as logs or large boulders. Many excavators now include fixed or movable thumbs to allow larger objects such as trees, rocks and pipes to be securely held and manipulated. In existing systems, the thumb and bucket are pivoted at different locations. For a given tool geometry, this has the effect of increasing the distance between the bucket pivot point and the leading edge of the bucket, thereby reducing the breakout force. Having multiple pivot points and connections between the main boom and bucket/thumb also complicates the overall design of the system, increasing manufacturing costs and reducing the ease of operation.

It is an object of the invention to obviate or mitigate the problems outlined above. In particular, it is an object of the invention to provide a tool for an excavator which can be easily mounted on an excavator boom.

It is a further object of the invention to provide a tool for an excavator which does not suffer from a reduced breakout force.

It is a further object of the invention to provide a tool for an excavator that is of simple design and can be easily mounted and operated.

It is a further object of the invention to provide a tool for an excavator which can be easily dismounted.

It is a further object of the invention to provide a tool for an excavator having a simplified overall design.

It is a further object of the invention to provide a tool for an excavator having reduced manufacturing costs.

According to a first aspect of the invention there is provided a tool for an excavator, the tool comprising: a primary engagement means; a secondary engagement means rotatable about an axis of rotation; and a connection means for connecting the tool to an excavator, wherein the axis of rotation of the secondary engagement means passes through the connection means. Advantageously, the axis of rotation passing through the connection means reduces the dimensions of the bucket for a given excavator geometry, minimising any loss of breakout force.

According to a second aspect of the invention there is provided a tool for an excavator, the tool comprising: a primary engagement means; a secondary engagement means rotatable about an axis of rotation; and a connection means for connecting the tool to an excavator, wherein the connection means is located proximally to the axis of rotation of the secondary engagement means. By 'proximally' it is meant that the distance between the connection means and the axis of rotation of the secondary engagement means is substantially minimised and/or reduced to minimise and/or reduce any loss of breakout force.

Ideally the tool is a standalone tool.

Preferably the tool is adapted to minimise and/or reduce any loss of breakout force.

Preferably the tool is manufactured from steel.

Preferably the tool is attachable to an excavator.

Preferably the tool is adapted for releasable attachment to an excavator.

Preferably the tool is adapted for releasable attachment to an excavator boom.

Preferably the tool is adapted for releasable attachment to an excavator main boom.

Preferably the tool is adapted to be coupled to an excavator main boom via a coupler.

Preferably the tool is adapted to be coupled to an excavator main boom via a coupler such as a quick coupler or a quick hitch coupler.

Preferably the tool is a claw bucket.

Preferably the tool is movable between open and closed positions.

Ideally the primary engagement means comprises an aperture.

Ideally the primary engagement means comprises a cavity.

Preferably the primary engagement means comprises a top wall, a bottom wall and two side walls.

Preferably the primary engagement means comprises a rear wall.

Preferably the primary engagement means comprises a curved rear wall.

Preferably the primary engagement means comprises a lower front edge, a top front edge and two side front edges.

Preferably the primary engagement means is a bucket.

Preferably the primary engagement means is an excavator bucket.

Preferably the primary engagement means comprises one or more teeth.

Preferably the primary engagement means comprises a plurality of teeth.

Preferably the primary engagement means comprises one or more interteeth space(s).

Preferably the teeth are connected to the bottom wall.

Preferably the teeth and interteeth space(s) are located on the lower front edge of the primary engagement means.

Ideally the connection means is connected to the primary engagement means.

Preferably the connection means is directly attached to the primary engagement means.

Preferably the connection means is directly connected to the primary engagement means via one or more welded joints.

Preferably the connection means is connected to the top wall and/or rear wall of the primary engagement means.

Preferably the connection means comprises one or more mounting members.

Preferably the connection means comprises at least a first mounting member.

Preferably the first mounting member is located proximally to a front edge of the primary engagement means.

Preferably the connection means comprises a second mounting member.

Preferably the connection means comprises at least a first mounting member and a second mounting member.

Preferably the second mounting member is located away from the first mounting member.

Preferably the first mounting member and the second mounting member are separated by a distance.

Preferably the second mounting member is located rearward of the first mounting member with respect to the front edge of the primary engagement means.

Preferably the or each mounting member comprises a mounting pin. Advantageously, the mounting pin(s) allow the tool to be mounted on an excavator main boom via e.g. a coupler such as a quick coupler or a quick hitch coupler.

Preferably the or each mounting member has a longitudinal axis.

Preferably the or each mounting member extends along a longitudinal axis.

Preferably the or each mounting member is an elongate member which extends along a longitudinal axis.

Ideally the axis of rotation of the secondary engagement means and the longitudinal axis of the mounting member are aligned or substantially aligned.

Ideally the axis of rotation of the secondary engagement means and the longitudinal axis of each mounting member are parallel.

Preferably the axis of rotation of the secondary engagement means and the longitudinal axis of the first mounting member are aligned or substantially aligned.

Preferably the axis of rotation of the secondary engagement means and the longitudinal axis of the first mounting pin are aligned or substantially aligned.

Preferably the axis of rotation of the secondary engagement means and the longitudinal axis of the first mounting member are coincident.

Preferably the axis of rotation of the secondary engagement means and the longitudinal axis of the first mounting member share a single axis.

Preferably the tool, when mounted on an excavator, is rotatable about an axis passing through the first mounting member.

Preferably the tool, when mounted on an excavator, is rotatable about the longitudinal axis of the first mounting member.

Preferably the distance between the first mounting member and the leading edge of the primary engagement means is at least 600 mm.

Preferably the distance between the first mounting member and the leading edge of the primary engagement means is at least 1000 mm.

Preferably the distance between the centre of the first mounting member and the leading edge of the primary engagement means is between 600 mm and 1600 mm.

Preferably the distance between the centre of the first mounting member and the leading edge of the primary engagement means is between 600 mm and 1400 mm.

Preferably the connection means comprises one or more support plates.

Preferably the connection means comprises two support plates.

Preferably the connection means comprises two spaced apart support plates.

Preferably the mounting members are attached to the support plates.

Preferably the mounting members extend between the support plates.

Preferably the mounting members extend in a parallel direction.

Preferably the mounting members are substantially perpendicular to the support plates.

Preferably the mounting members are attached to the primary engagement means.

Preferably the mounting members are attached to the primary engagement means via the support plates.

Preferably the support plates are attached to the primary engagement means.

Preferably the support plates are directly attached to the primary engagement means.

Preferably the support plates are attached to the primary engagement means via welded joints.

Preferably the rotation axis passes through the connection means.

Preferably the rotation axis passes through a mounting member.

Preferably the rotation axis passes through a mounting pin.

Preferably the rotation axis passes through the primary mounting pin. Advantageously, the rotation axis passing through the primary mounting pin ensures that the distance between the pivot points of the primary and secondary engagement means is minimized.

Ideally the secondary engagement means is a thumb.

Ideally the secondary engagement means is mounted on the primary engagement means.

Preferably the secondary engagement means is pivotably connected to the primary engagement means. Advantageously, the secondary engagement means being pivotably connected to the primary engagement means removes any need for the secondary engagement means to be mounted e.g. on the excavator boom, reducing the overall size and complexity of the system.

Preferably the secondary engagement means is rotatably connected to the primary engagement means.

Preferably the secondary engagement means is rotatably mounted on the primary engagement means.

Preferably the secondary engagement means is connected to the primary engagement means via a pivot pin.

Preferably the secondary engagement means is rotatably connected to the pivot pin.

Preferably the pivot pin is rigidly attached to the primary engagement means.

Preferably the secondary engagement means is connected to the primary engagement means for moving between an opened and a closed position.

Preferably the primary engagement means and secondary engagement means define a jaw for gripping an object.

Preferably the primary engagement means and/or secondary engagement means comprise one or more serrated edges Ideally the primary engagement means and/or secondary engagement means comprise one or more gripping means. Advantageously, gripping means allow an object to be held by the tool more securely.

Preferably the gripping means comprises at least one gripping formation.

Preferably the or each gripping formation comprises a serrated edge.

Preferably the gripping means comprises one or more serrated edges.

Preferably the gripping means are located on the inner surfaces of the primary engagement means and/or secondary engagement means in the closed position.

Preferably gripping means are located on one or both of the two side front edges of the primary engagement means.

Ideally the secondary engagement means comprises one or more engagement elements.

Preferably the secondary engagement means comprises a plurality of engagement elements.

Preferably the or each engagement element is a tine.

Preferably the secondary engagement means comprises one or more tines.

Preferably the secondary engagement means comprises a plurality of tines.

Preferably the or each tine comprises a serrated edge.

Preferably the or each engagement element comprises an engagement edge.

Preferably gripping means are located on the engagement edge of each engagement element.

Preferably the or each engagement element comprises a tip.

Preferably the tips of the engagement elements are locatable between the teeth of the primary engagement means.

Preferably in the closed position the tips of the engagement elements are located between the teeth of the primary engagement means.

Preferably the secondary engagement means comprises one or more spacing means.

Preferably the or each spacing means is a bar.

Preferably the engagement elements are connected by the one or more spacing means.

Preferably the engagement elements are connected to the spacing means.

Preferably the engagement elements are rigidly connected to the spacing means.

Preferably the engagement elements are connected to the spacing means via welded joints.

Preferably the engagement elements extend between one or more spacing means.

Preferably the spacing means are adapted to laterally space the engagement elements.

Preferably the or each engagement element extends in a direction substantially parallel to the sidewalls of the primary engagement means.

Preferably the engagement elements extend in a direction that is substantially perpendicular to the spacing means.

Preferably the secondary engagement means comprises one or more pivotable engagement elements.

Preferably the secondary engagement means comprises a plurality of pivotable engagement elements.

Preferably the secondary engagement means comprises two pivotable engagement elements.

Preferably the pivotable engagement elements are located at the peripheral edge of the secondary engagement means.

Preferably the or each pivotable engagement element is pivotably connected to the primary engagement means.

Preferably the or each pivotable engagement element comprises a pivot aperture for receiving a pivot pin.

Preferably the secondary engagement means comprises a plurality of further engagement elements.

Preferably the secondary engagement means comprises three further engagement elements.

Preferably the or each further engagement element is located between neighbouring pivotable means.

Preferably the or each further engagement element is rigidly connected to the spacing means.

Preferably the or each further engagement element is not directly connected to the primary engagement means.

Preferably the secondary engagement means comprises one or more connection elements.

Preferably the or each connection element is pivotably connected to the primary engagement means.

Preferably the or each connection element is rigidly connected to a spacing means.

Ideally the tool comprises at least one actuation means.

Preferably the tool comprises at least one actuation means for moving the tool between the open and closed positions.

Preferably the tool comprises at least two actuation means.

Preferably the tool comprises two actuation means.

Preferably the or each actuation means is a hydraulic actuator.

Preferably the or each hydraulic actuator is connectable to a hydraulic system of the excavator.

Preferably the or each actuation means is connected to the primary engagement means.

Preferably the or each actuation means is connected to the primary engagement means via a mounting pin.

Preferably the or each actuation means is connected to the primary engagement means via a mounting pin located in at least one mounting plate.

Preferably the or each actuation means is connected to the secondary engagement means.

Preferably the or each actuation means is connected to the secondary engagement means via a mounting pin.

Preferably the or each actuation means is connected to the secondary engagement means via a mounting pin located in at least one pivotable engagement element.

Preferably the or each actuation means is connected to the secondary engagement means via a mounting pin located in at least one pivotable engagement element and at least one connection element.

Preferably the or each pivotable engagement element comprises an aperture for receiving a mounting pin.

Preferably the or each connection element comprises an aperture for receiving a mounting pin.

Preferably the or each actuation means is connected between the primary engagement means and the secondary engagement means.

Preferably the or each actuation means is pivotably connected to the primary engagement means and the secondary engagement means.

Preferably the actuation means are located on either side of the connection means.

Preferably, in use, actuation of the or each actuation means causes the tool to move between the closed position and the open position.

Preferably, in use, extension of the or each actuation means causes the tool to move from the open position to the closed position.

Preferably, in use, contraction of the or each actuation means causes the tool to move from the closed position to the open position.

Preferably in the closed position, the primary engagement means and the secondary engagement means are adjacent to one another.

Preferably in the closed position, the lower front edge of the primary engagement means and the free end of the secondary engagement means are adjacent to one another.

Preferably in the open position the primary engagement means and the secondary engagement means are separated.

Preferably in the open position, the primary engagement means and the secondary engagement means are separated to allow objects pass therebetween.

Preferably in the closed position, the tip(s) of the primary engagement means is/are situated between the teeth of the secondary engagement means.

Preferably in the open position, the tip(s) of the primary engagement means is/are situated away from the teeth of the secondary engagement means.

According to a second aspect of the invention there is provided an excavator comprising the tool.

Preferably the tool is attached to a boom of the excavator.

Preferably the tool is releasably attached to the main boom of the excavator.

Preferably the tool is releasably attached to the main boom of the excavator via a coupler.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which show, by way of example only, embodiments of apparatus in accordance with the invention.

FIG. 1*a* is a side view of an excavator and a tool.

FIG. 1*b* is a close-up side view of the connection between the excavator arm and tool shown in FIG. 1*a*.

FIG. 2*a* is a side view of a bucket for use with an aspect of the invention.

FIG. 2*b* is a side view of a tool in accordance with an aspect of the invention.

FIG. 3*a* is a perspective view of a tool in accordance with an aspect of the invention.

FIG. 3*b* is a perspective view of a tool in accordance with an aspect of the invention.

FIG. 4*a* is a front view of a tool in accordance with an aspect of the invention.

FIG. 4*b* is a rear view of a tool in accordance with an aspect of the invention.

FIG. 4*c* is a top view of a tool in accordance with an aspect of the invention.

FIG. 4*d* is a bottom view of a tool in accordance with an aspect of the invention.

Figure 1A:
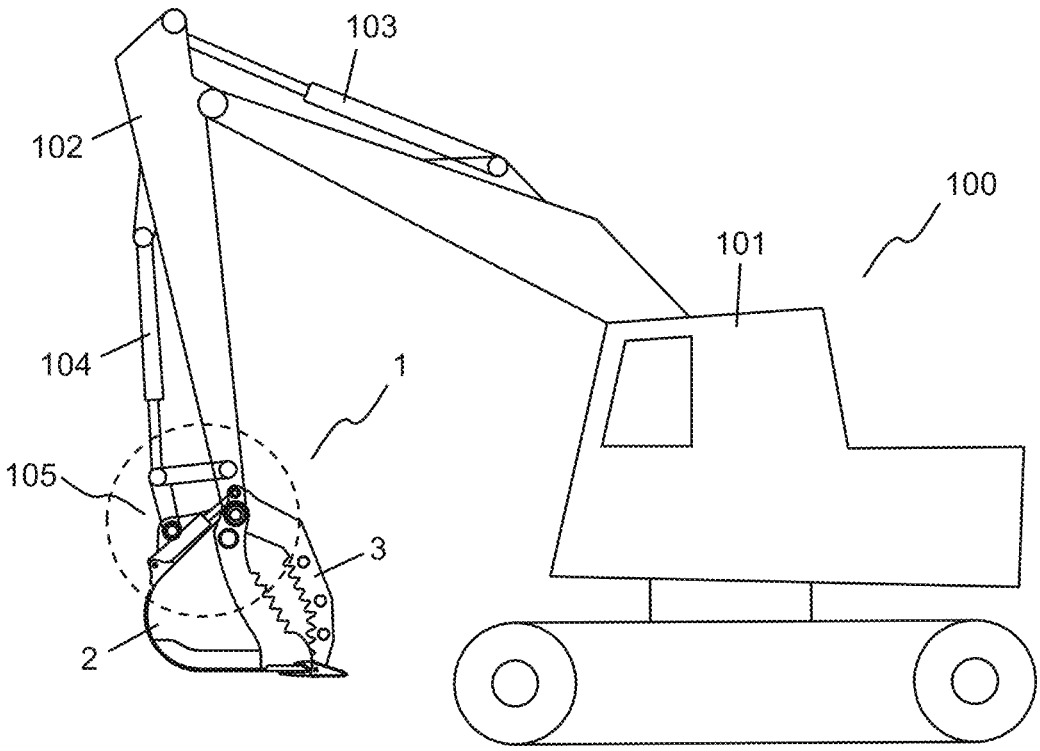
Figure 1B:
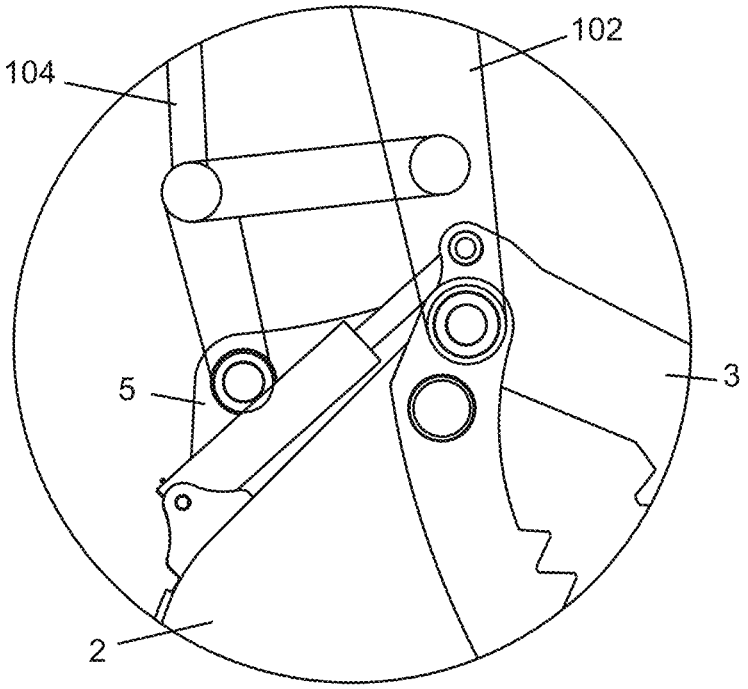

In FIG. 1*a* there is shown a tool 1 mounted on an excavator 100. The excavator 100 comprises a main body 101, a boom arm 102 and hydraulic cylinders 103 and 104. The tool 1 comprises a primary engagement arrangement 2, a secondary engagement arrangement 3 rotatable about an axis of rotation A, and a connection arrangement 5 for connecting the tool 1 to the excavator 100 (see detail in FIG. 1*b*). The tool 1 is a standalone tool which can be attached to the end 105 of the excavator main boom 102. In the example embodiments the tool 1 is a claw bucket 1 and is movable between open and closed positions.

Figure 2A:
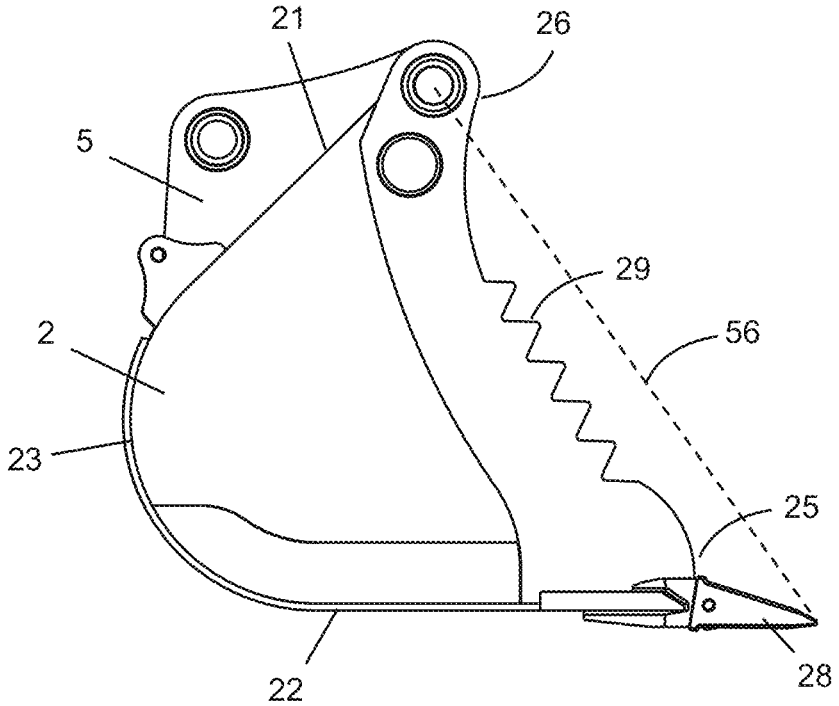

The primary engagement arrangement 2 is shown in FIG. 2*a*. In this embodiment, the primary engagement arrangement 2 is formed as a bucket 2 comprising a cavity 2*a*. In this example the bucket 2 is an excavator bucket 2 comprising a top wall 21*a*, a bottom wall 22, a curved rear wall 23 and two side walls 24*a*,24*b* (see also FIGS. 3*a* and 3*b*). The bucket 2 comprises a lower front edge 25, a top front edge 26 and two side front edges 27*a*,27*b* (see also FIG. 4*a*). The bucket 2 comprises a plurality of teeth 28 which are separated by interteeth spaces 28*a*. The teeth 28 and interteeth spaces 28*a* are connected to the bottom wall 22 and are located on the lower front edge 25 of the bucket 2.

The connection arrangement 5 is connected to the bucket 2 via direct attachment (e.g. via welding/one or more welded joints 2*b*). As shown in FIGS. 2*a* and 3*b*, the connection arrangement 5 is connected to the top wall 21 and rear wall 23 of the bucket 2. As best shown in FIG. 3*b*, the connection arrangement 5 comprises a first mounting member 51 and a second mounting member 52. Each mounting member 51,52 is an elongate member which extends along a longitudinal axis. Each mounting member 51,52 is a mounting pin having a longitudinal axis B,C which is substantially parallel to the rotation axis A of the secondary engagement arrangement 3. The mounting members 51,52 extend in a parallel direction. The connection arrangement 5 comprises two spaced apart support plates 53*a*,53*b* to which the mounting members 51,52 are attached and between which the mounting members 51,52 extend. The mounting members 51,52 are substantially perpendicular to the support plates 53*a*,53*b*. The mounting members 51,52 are attached to the bucket 2 via support plates 53*a*,53*b*. The support plates 53*a*,53*b* are directly attached to the primary engagement arrangement 2 via welded joints 2*b*. The second mounting member 52 is located away from the first mounting member 51. The first mounting member 51 and the second mounting member 52 are separated by a distance 55 (see FIG. 4*c*). The second mounting member 52 is located rearward of the first mounting member 51 with respect to the top front edge 26 of the bucket 2.

The tool 1, when mounted on excavator 100, is rotatable about the longitudinal axis B of the first mounting member 51, which is coincident with the rotation axis A of the thumb 3. The axis of rotation A of the secondary engagement arrangement 3 is parallel to the longitudinal axes B,C of the mounting members 51,52. The distance 56 between the axis B of the first mounting member 51 and the leading edge 25 of the bucket 2 (denoted by a dashed line 56 in FIG. 2*a*) is greater than 600 mm and/or greater than 1000 mm, and can be between 600 mm and 1600 mm and/or between 1000 mm and 1400 mm. In preferred embodiments the distance 56 between the axis B of the first mounting member 51 and the leading edge of the bucket 2 is 1388.12 mm.

Figure 2B:
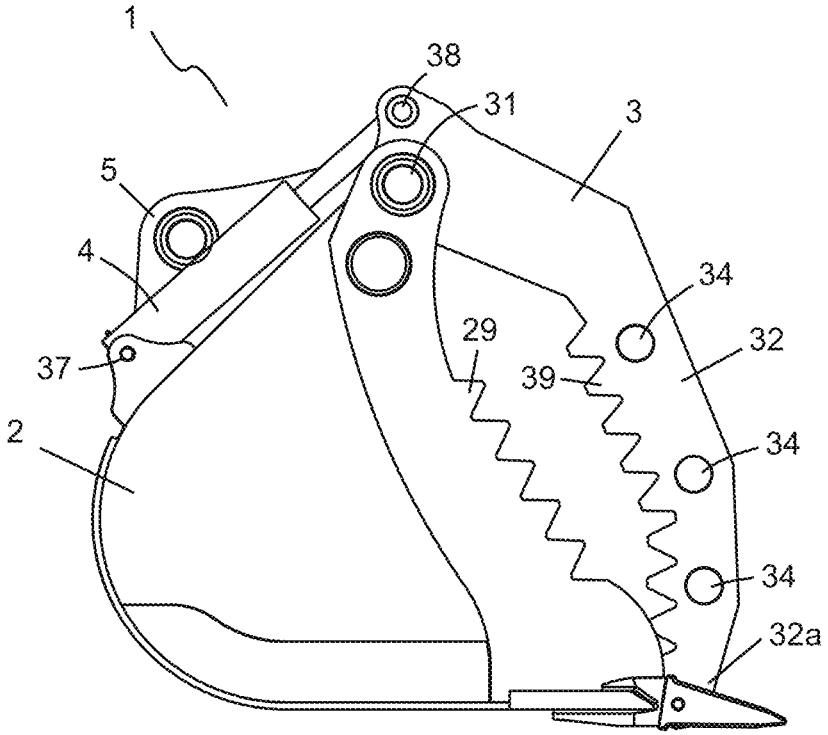

Returning to FIG. 2*b*, the secondary engagement arrangement 3 is a thumb 3 which can be used in conjunction with bucket 2 to securely hold and manipulate large objects. The thumb 3 is mounted on the bucket 2 and is pivotably connected thereto via pivot pins 31. The thumb 3 being pivotably connected to the bucket 2 removes any need for the thumb 3 to be mounted e.g. on the excavator boom 102, reducing the overall size and complexity of the tool 1 and excavator 100 system. The thumb 3 is rotatably connected to the pivot pins 31. The pivot pins 31 are rigidly attached to the bucket 2.

In the example embodiments shown in the figures, the bucket 2 and thumb 3 comprise gripping arrangements 29,39. The gripping arrangements 29,39 comprise serrated edges 29,39 located on the inner surfaces of the bucket 2 and thumb 3 in the closed position of the tool 1. The gripping arrangements 29 are located on the side front edges 27*a*,27*b* of the bucket 2.

Figure 3A:
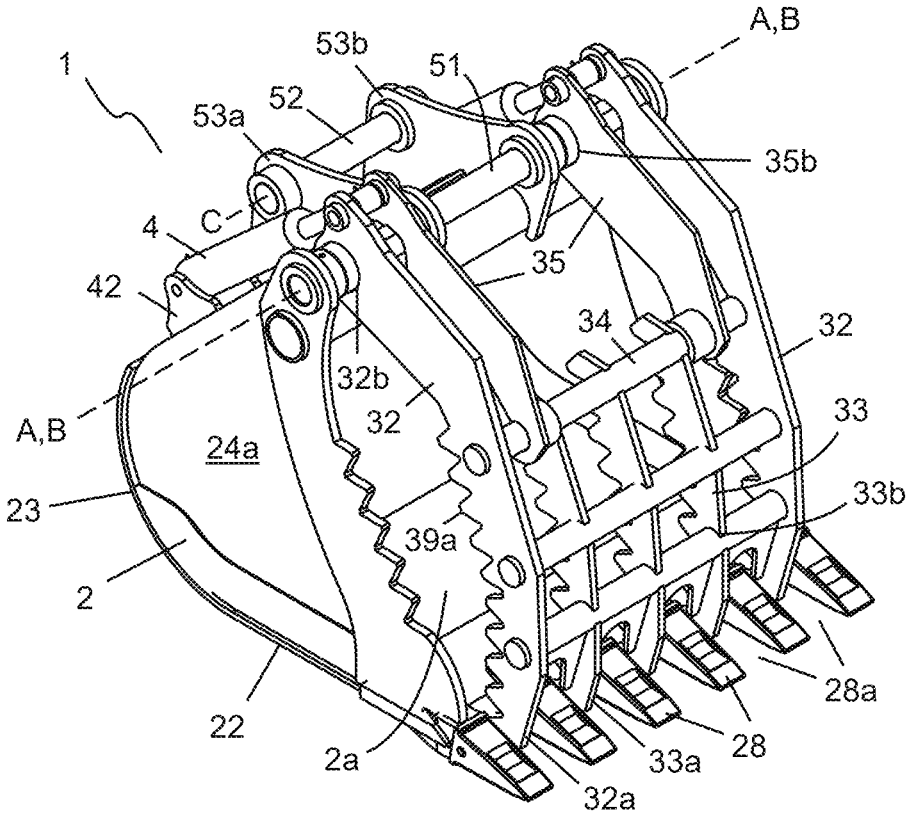
Figure 3B:
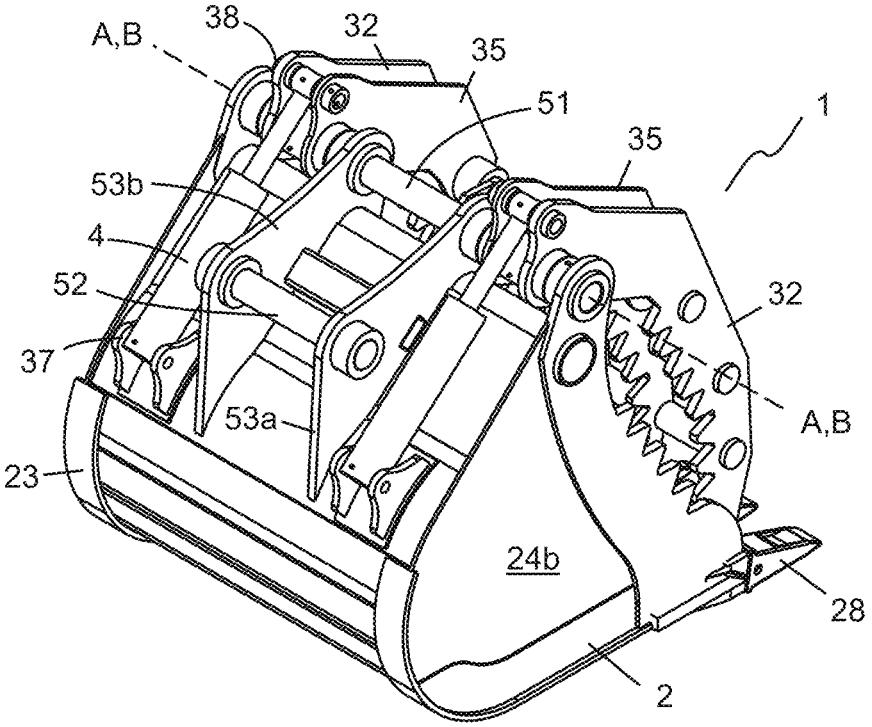

As shown in FIG. 3*a*, the thumb 3 comprises a plurality of engagement elements 32,33. Each engagement element 32,33 is a tine having a serrated edge 39 and which, in use, extends in a direction parallel to the sidewalls 24*a*,24*b* of the bucket 2. Each engagement element 32,33 comprises an engagement edge 39*a*. Gripping arrangements 39 are located on the engagement edge 39*a* of each engagement element 32,33. Each engagement element 32,33 comprises a tip 32*a*,33*a*. In the closed position of the tool 1 (shown in e.g.

FIG. 3*a*) the tips 32*a*,33*a* of the engagement elements 32,33 are situated between the teeth 28 of the bucket 2 i.e. within the interteeth spaces 28*a*. When the tool 1 is being moved out of the closed position and into the open position the tips 32*a*,33*a* of the engagement elements 32,33 are moved away from the teeth 28 of the bucket 2 i.e. they are moved out of the interteeth spaces 28*a*.

The thumb 3 comprises a plurality of spacer elements 34. In the preferred embodiment shown in the figures, each spacer element 34 is a bar. The engagement elements 32,33 are rigidly connected to one another (and are laterally spaced from one another) by the spacer elements 34. The spacer elements 34 extend between the engagement elements 32,33. The engagement elements 32,33 extend in a direction that is substantially perpendicular to the spacer elements 34.

The thumb 3 comprises two pivotable engagement elements 32. The pivotable engagement elements 32 are located at the peripheral edges of the thumb 3 and are adjacent to the sidewalls 24*a*,24*b* of the bucket 2. Each pivotable engagement element 32 is pivotably connected to the bucket 2. Each pivotable engagement element 32 comprises a pivot aperture 32*b* for receiving a pivot pin 31.

The thumb 3 comprises three further engagement elements 33. Each further engagement element 33 is located between the pivotable engagement elements 32. Each further engagement element 33 is rigidly connected to the spacer elements 34 via e.g. welded joints 33*b*. Each further engagement element 33 is not directly connected to the bucket 2. Instead, each further engagement element 33 is indirectly connected to the bucket 2 via spacer elements 34, pivotable engagement elements 32 and pivot pins 31.

The thumb 3 comprises two connection elements 35. Each connection element is a tine. Each connection element 35 is pivotably connected to the bucket 2 at one end and is rigidly connected to a spacer element 34 at the opposite end. Each connection element 35 is rigidly connected to an adjacent pivotable engagement element 32 via a plate 35*a* (see FIGS. 5 and 6, discussed below).

The tool 1 comprises two hydraulic actuators 4. Both hydraulic actuators 4 are operably connectable to the hydraulic system 103,104 of the excavator 100 for moving the tool 1 between the open and closed positions. As shown in FIG. 3*b*, each hydraulic actuator 4 is connected between the bucket 2 and the thumb 3. The hydraulic actuators 4 are located on either side of the connection arrangement 5. The connection arrangement 5 is located between the hydraulic actuators 4.

Each hydraulic actuator 4 is connected to the bucket 2 via a mounting pin 37 located in mounting plates 42. Each hydraulic actuator 4 is connected to the thumb 3 via a further mounting pin 38 located in the pivotable engagement element 32 and connection element 35. Each pivotable engagement element 32 comprises an aperture 32*b* for receiving the further mounting pin 38. Each connection element 35 also comprises an aperture 35*b* for receiving the further mounting pin 38.

In use, the bucket 2 and thumb 3 define a jaw 1 for gripping an object. The thumb 3 is connected to the bucket 2 such that the tool 1 can move between an open position (in which the bucket 2 and thumb 3 are separated to allow objects to pass therebetween) and a closed position (in which the bucket 2 and thumb 3 are in close proximity, with the tip(s) 32*a* of the thumb 3 being situated between the teeth 28 of the bucket 2—see e.g. FIG. 3*a*). Actuation of the hydraulic actuators 4 causes the tool 1 to move between the closed position and the open position. Extension of the hydraulic actuators 4 causes the tool 1 to move from the open position to the closed position. Contraction of the hydraulic actuators 4 causes the tool 1 to move from the closed position to the open position.

As shown in FIGS. 3*a* and 3*b*, the connection arrangement 5 is located proximally to the axis of rotation A of the secondary engagement arrangement 3. By 'proximally' it is meant that the distance between the connection arrangement 5 and the axis of rotation A of the secondary engagement arrangement 3 is substantially minimised to minimise any loss of breakout force. In the preferred embodiments the rotation axis A passes through the connection arrangement 5, particularly through the primary mounting pin 51. The primary mounting pin 51 has a longitudinal axis B and this longitudinal axis B is aligned, or at least substantially aligned, with the axis of rotation A of the secondary engagement arrangement 3. In other words, the distance between the axis A of the secondary engagement arrangement 3 and the longitudinal axis B of the first mounting pin 51 is reduced/minimised. In the most preferable embodiments the axis of rotation A of the secondary engagement arrangement 3 and the longitudinal axis B of the first mounting pin 51 are coincident i.e. they share a single axis. The secondary mounting pin 52 has a longitudinal axis C which is parallel to A and B.

In the embodiments shown in the figures, the axis of rotation A is the axis about which the bucket and thumb 2,3 mutually rotate. This axis A coincides with the axis of rotation of the tool 1 with respect to the main boom 102 (see FIGS. 1*a* and 1*b*). The rotation axis of the tool 1 corresponds to the longitudinal axis B of the primary mounting pin 51. In particular, the rotation axis of the tool 1 (i.e. the rotation axis of the thumb 3) passes through the primary mounting pin 51. By having the rotation axis of the tool 1 being also the rotation axis of the thumb 3, any loss of breakout force is minimised for a given size of tool 1 (particularly, for a fixed distance between the tool's pivot and its leading edge).

Figure 4A:
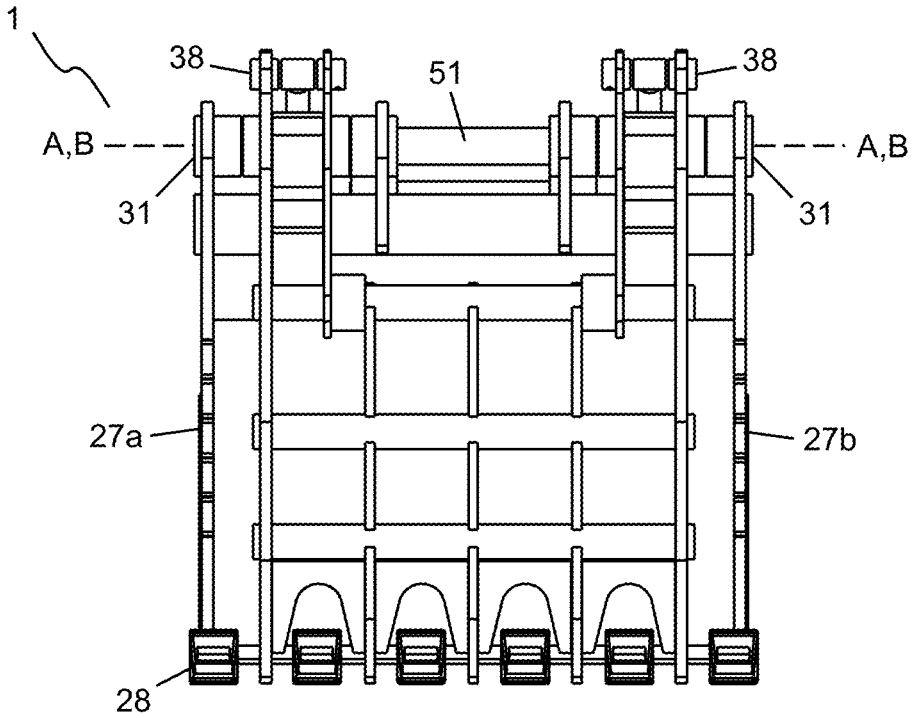
Figure 4B:
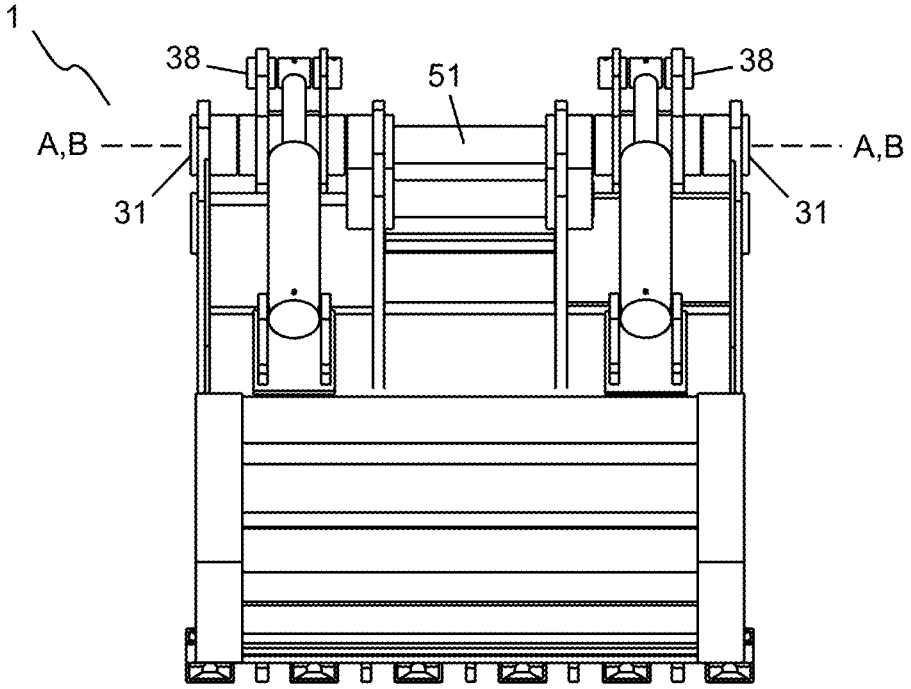
Figure 4C:
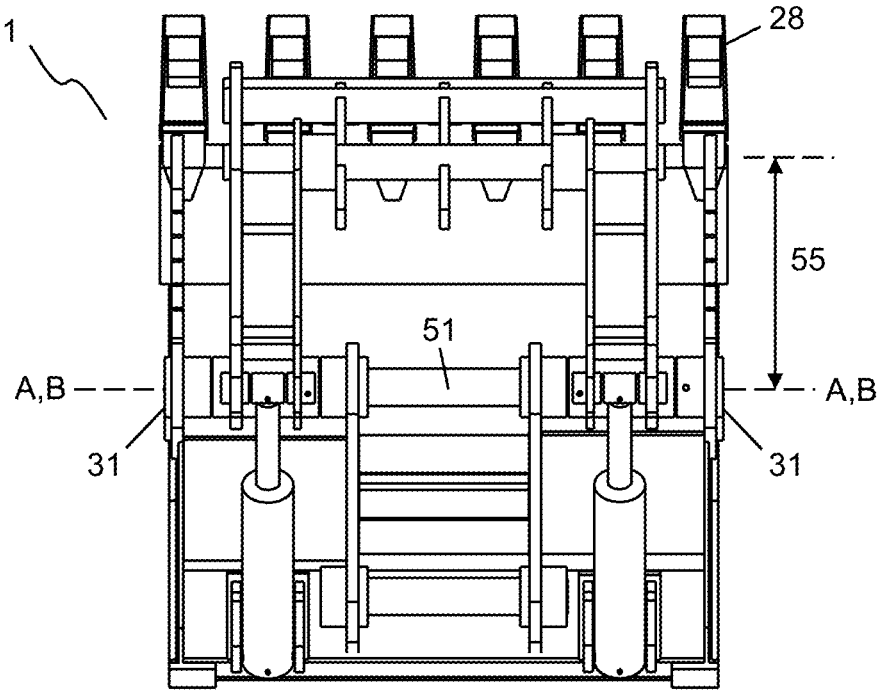
Figure 4D:
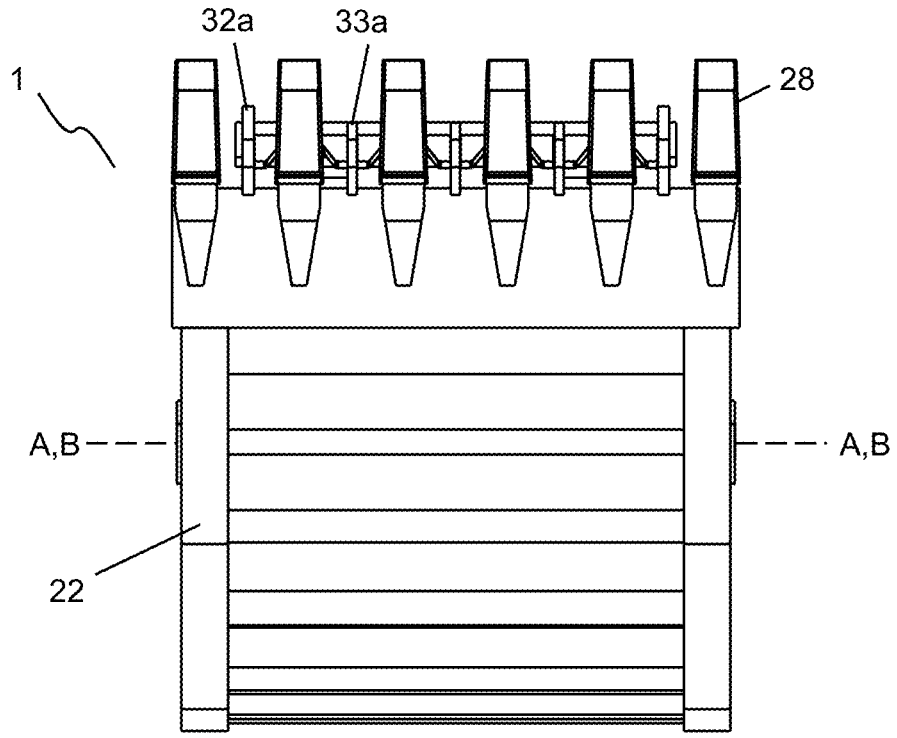

FIGS. 4*a* and 4*b* show front and rear views of the tool 1, respectively, and FIGS. 4*c* and 4*d* show top and bottom views of the tool 1, respectively. As can be clearly seen in FIGS. 4*a-c*, the axis of rotation A passes through the first mounting pin 51 and the pivot pins 31. In the preferred embodiments these pins share a mutual axis A and may be integrally formed (i.e. formed of a single pin).

Figure 5:
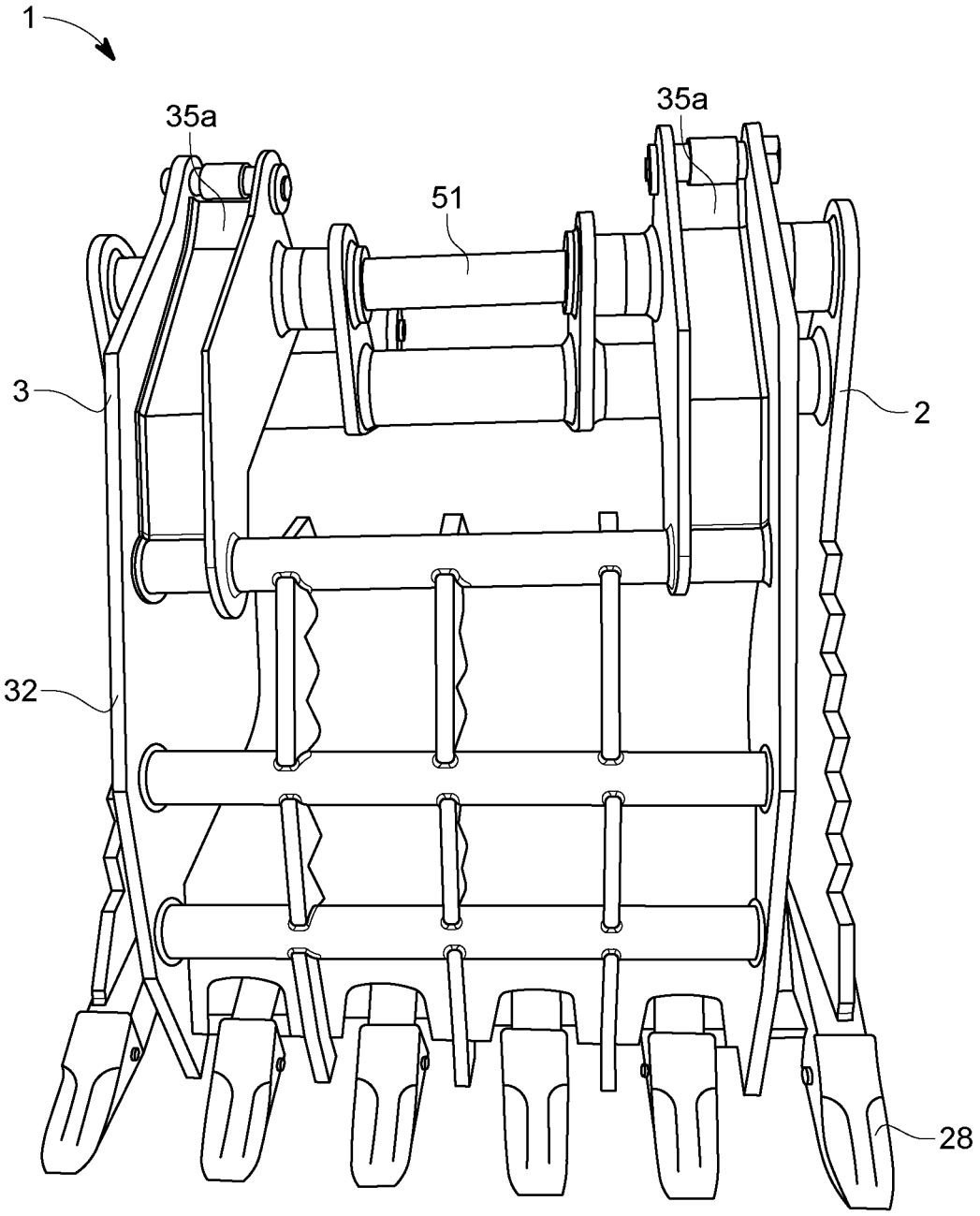
FIG. 5 is a front perspective view of a tool in accordance with an aspect of the invention.
Figure 6:
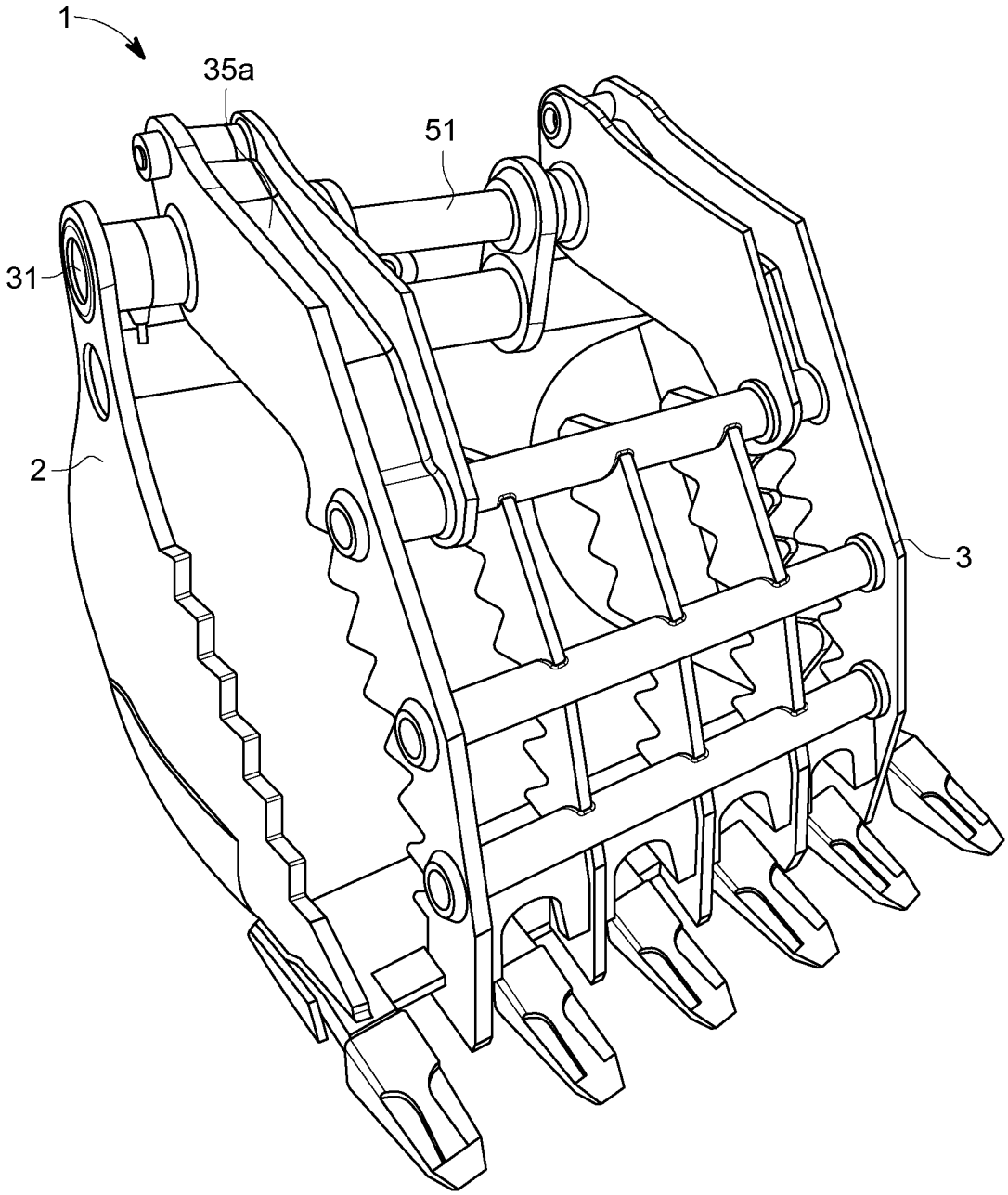
FIG. 6 is a perspective view of a tool in accordance with an aspect of the invention.

FIGS. 5 and 6 show perspective views of the front of the tool 1. In particular, FIGS. 5 and 6 show the location of the first mounting pin 51 between the pivot pins 31 and pivotable engagement elements 32 of the thumb 3. FIGS. 5 and 6 also show each connection element 35 being rigidly connected to a respective pivotable engagement element 32 via a plate 35*a*.

Figure 7:
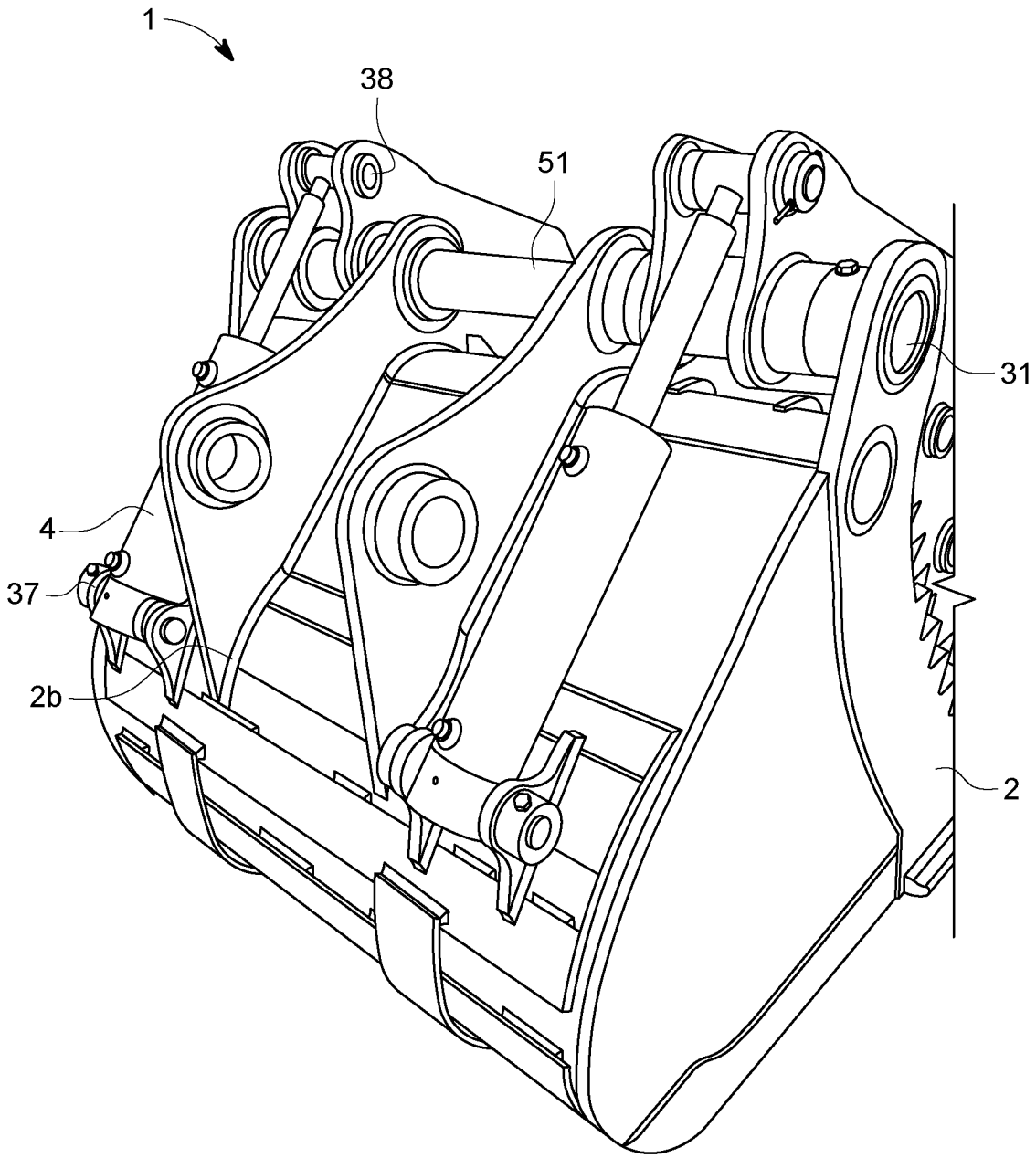
FIG. 7 is a rear perspective view of a tool in accordance with an aspect of the invention.

FIG. 7 shows a perspective view of the rear of tool 1. In particular, FIG. 7 shows the connection between the hydraulic actuators 4 and the bucket and thumb 2 and 3.

Figure 8:
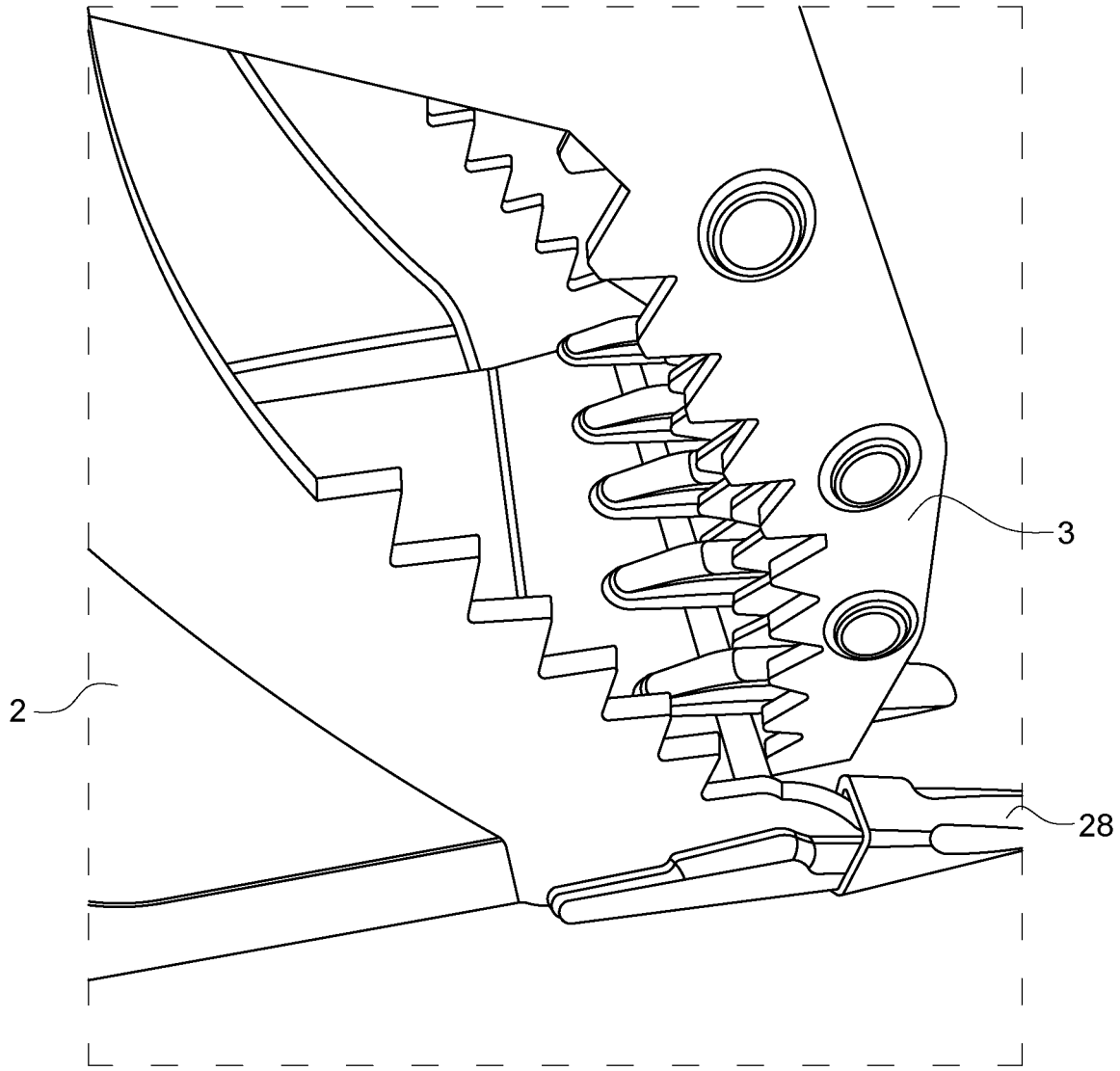
FIG. 8 is a side perspective view of a tool in accordance with an aspect of the invention.
Figure 9:
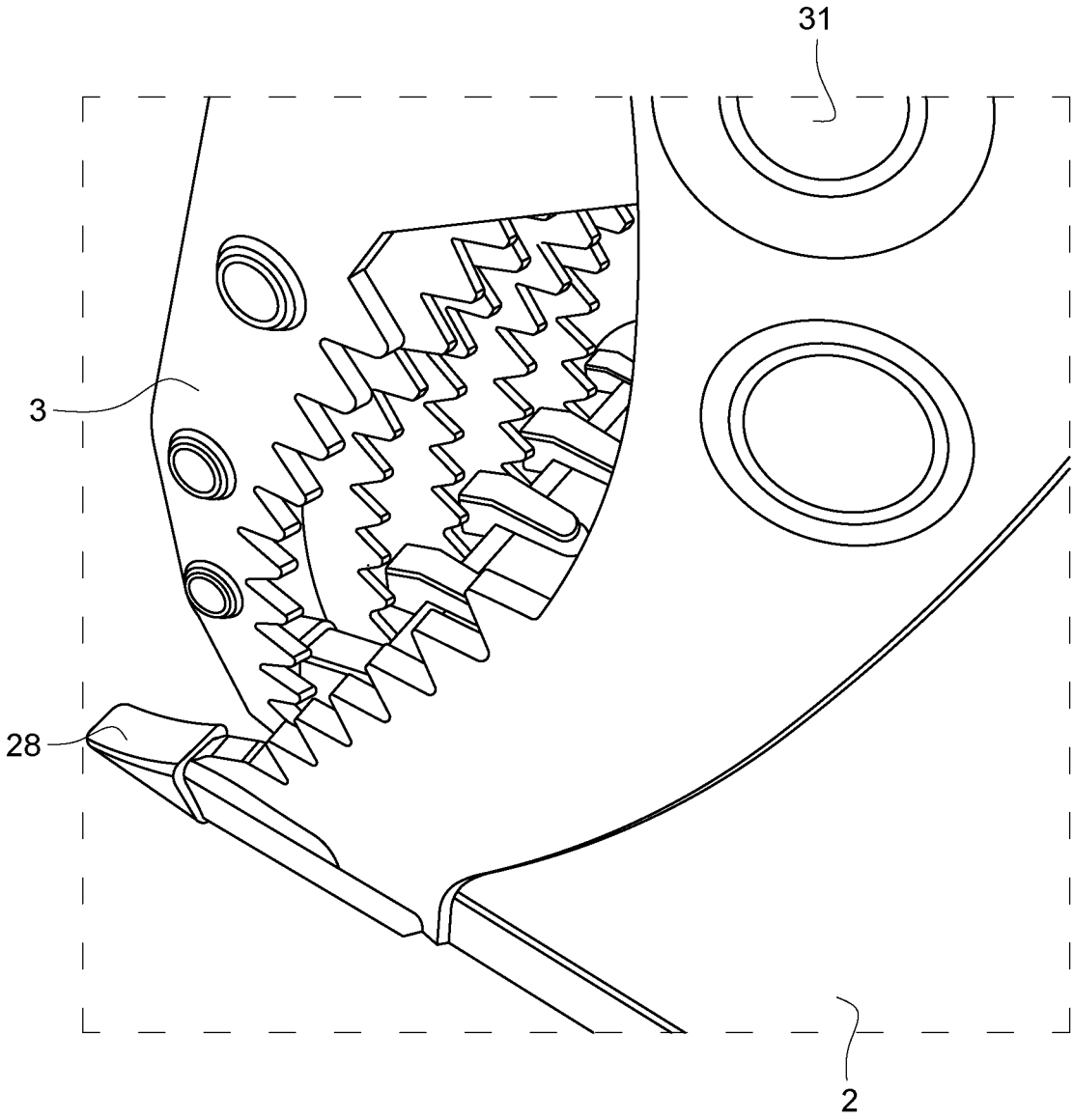
FIG. 9 is an alternative side perspective view of a tool in accordance with an aspect of the invention.

FIGS. 8 and 9 show perspective views of the respective sides of tool 1, particularly the locations of the gripping arrangements 29,39 on the inner surfaces of the bucket and thumb when the tool 1 is in the closed position.

As will be understood by the skilled person, the example embodiments presented above can be modified in a number of ways without departing from the scope of the invention. For example, the tool 1 may be releasably coupled to an excavator 100 via a coupler such as a quick coupler or quick hitch coupler located on the end of the excavator main boom 102. The primary engagement arrangement 2 and secondary engagement arrangement 3 may be of any suitable shape to form any suitable tool for mounting on an excavator 100. For example, the primary engagement arrangement 2 and secondary engagement arrangement 3 may both be buckets or both be thumbs. The secondary engagement arrangement 3 may comprise more or fewer engagement elements 32,33 and may include any number of spacing elements 35, for example one, two or greater than three. The tool 1 may include only one actuation means and the actuation means can be any suitable type of actuator.

In the preceding discussion of the invention, unless stated to the contrary, the disclosure of alternative values for the upper or lower limit of the permitted range of a parameter, coupled with an indication that one of the values is more highly preferred than the other, is to be construed as an implied statement that each intermediate value of the parameter, lying between the more preferred and the less preferred of the alternatives, is itself preferred to the less preferred value and also to each value lying between the less preferred value and the intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

What is claimed is:

1. A tool for an excavator, the tool comprising: a primary engagement means; a secondary engagement means rotatable about an axis of rotation; and a connection means for connecting the tool to an excavator, wherein the axis of rotation of the secondary engagement means passes through the connection means and aligns with an axis of rotation of the tool relative to the excavator; at least one actuation means wherein the at least one actuation means is a hydraulic actuator which is connected to the primary engagement means at one end and the secondary engagement means at other end for moving the tool between an open and closed position; wherein the secondary engagement means and primary engagement means mutually rotate about the same axis of the rotation by the same actuation means mounted on the primary engagement means; wherein the connection means comprises one or more mounting members; wherein the at least one actuation means is connected to the primary engagement means via a mounting pin located in at least one mounting plate mounted on the primary engagement means; wherein the one or more mounting plates are located spaced apart from the connection means; wherein the secondary engagement means comprising a plurality of engagement elements; wherein the at least one actuation means is connected to the secondary engagement means via a further mounting pin located in at least one engagement element; wherein the secondary engagement means comprises a plurality of spacing means; wherein the spacing means is a bar; wherein all engagement elements are rigidly connected to the same spacing means.

2. The tool according to claim 1, wherein the tool is adapted for releasable attachment to an excavator boom.

3. The tool according to claim 1, wherein the connection means comprises at least a first mounting member and a second mounting member.

4. The tool according to claim 3, wherein each mounting member is an elongate member which extends along a longitudinal axis.

5. The tool according to claim 4, wherein each mounting member comprises a mounting pin.

6. The tool according to claim 5, wherein the axis of rotation of the secondary engagement means and the longitudinal axis of the first mounting member are aligned or substantially aligned.

7. The tool according to claim 3, wherein the axis of rotation of the secondary engagement means and the longitudinal axis of the first mounting member are coincident.

8. The tool according to claim 1, wherein the tool is movable between open and closed positions.

9. The tool according to claim 1, wherein the at least one actuation means is connectable to a hydraulic system of the excavator.

10. The tool according to claim 1, wherein the at least one actuation means is pivotably connected to the primary engagement means and the secondary engagement means.

11. The tool according to claim 1, wherein, in use, extension of the at least one actuation means causes the tool to move from the open position to the closed position.

12. The tool according to claim 1, wherein, in use, contraction of the at least one actuation means causes the tool to move from the closed position to the open position.

13. The tool according to claim 1, wherein the primary engagement means and secondary engagement means define a jaw for gripping an object.

14. The tool according to claim 1, wherein the tool is a claw bucket.

15. The tool according to claim 1, wherein the primary engagement means is a bucket.

16. The tool according to claim 1, wherein the secondary engagement means is a thumb.

17. The tool according to claim 1, wherein the connection means is directly connected to the primary engagement means via one or more welded joints.

18. The tool according to claim 1, wherein the tool comprises two hydraulic actuators; wherein the two hydraulic actuators are operably connectable to the hydraulic system of the excavator for moving the tool between the open and closed positions.

19. The tool according to claim 1, wherein the at least one actuation means is located on either side of the connection means.

* * * * *